US009031426B2

(12) United States Patent
Zollner et al.

(10) Patent No.: US 9,031,426 B2
(45) Date of Patent: May 12, 2015

(54) METHOD TO OPERATE A DIGITAL PRINTER AND DETERMINE THE TONER CONCENTRATION, AS WELL AS AN ASSOCIATED DIGITAL PRINTER

(71) Applicants: Alfred Zollner, Eitting (DE); Alfons Ritzer, Dorfen (DE); Martin Berg, Poing (DE); Attila Bogdan, Rattenkirchen (DE)

(72) Inventors: Alfred Zollner, Eitting (DE); Alfons Ritzer, Dorfen (DE); Martin Berg, Poing (DE); Attila Bogdan, Rattenkirchen (DE)

(73) Assignee: Océ Printing Systems GmbH, Poing (DE)

( * ) Notice: Subject to any disclaimer, the term of this patent is extended or adjusted under 35 U.S.C. 154(b) by 100 days.

(21) Appl. No.: 13/864,645

(22) Filed: Apr. 17, 2013

(65) Prior Publication Data

US 2013/0272734 A1 Oct. 17, 2013

(30) Foreign Application Priority Data

Apr. 17, 2012 (DE) ..... 10 2012 103 336

(51) Int. Cl.
*G03G 15/08* (2006.01)
*G03G 15/10* (2006.01)

(52) U.S. Cl.
CPC ..... *G03G 15/0824* (2013.01); *G03G 15/105* (2013.01); *G03G 15/0851* (2013.01); *G03G 15/0849* (2013.01)

(58) Field of Classification Search
CPC ..... G03G 15/105
USPC ..... 399/30, 57, 61, 62
See application file for complete search history.

(56) References Cited

U.S. PATENT DOCUMENTS

| | | | | |
|---|---|---|---|---|
| 7,570,893 | B2 | 8/2009 | Holland | |
| 8,336,372 | B2 | 12/2012 | Ritzer et al. | |
| 2011/0058838 | A1* | 3/2011 | Ritzer et al. | 399/61 |
| 2011/0150534 | A1 | 6/2011 | Kopp | |

FOREIGN PATENT DOCUMENTS

| | | | |
|---|---|---|---|
| DE | 10 2008 047 196 | A1 | 4/2010 |
| DE | 10 2008 048 256 | A1 | 4/2010 |
| DE | 10 2009 060 334 | A1 | 6/2011 |
| DE | 10 2010 015 985 | A1 | 9/2011 |
| JP | 2001-142306 | A | 5/2001 |

OTHER PUBLICATIONS

German Patent Office Action dated Nov. 2, 2012 (9 pages).
The Fundamentals of Particle Size Analysis by Means of Ultrasonic Spectrometry, Ulrich et al., Par. Part. Syst. Charact. 6 (1998) pp. 135-143.

* cited by examiner

*Primary Examiner* — David Gray
*Assistant Examiner* — Andrew V Do
(74) *Attorney, Agent, or Firm* — Schiff Hardin LLP

(57) ABSTRACT

In a method or digital printer to print a recording material with toner particles applied with a liquid developer, toner concentration of the liquid developer is determined via measurement with aid of ultrasonic pulses. At least one ultrasonic pulse is generated by discharging an ultrasound emitter charged with a charge voltage. The ultrasonic pulse permeates the liquid developer and is received by an ultrasound receiver which generates a reception signal corresponding to the received ultrasonic pulse. With a control device, the charge voltage is regulated to a value such that a representative value of the reception signal corresponds to a predetermined desired value. The toner concentration is determined from the regulated charge voltage.

12 Claims, 12 Drawing Sheets

METHOD TO OPERATE A DIGITAL PRINTER AND DETERMINE THE TONER CONCENTRATION, AS WELL AS AN ASSOCIATED DIGITAL PRINTER

BACKGROUND

The disclosure concerns a method to operate a digital printer to print a recording material with toner particles that are applied with the aid of a liquid developer, in particular a high-speed printer to print web-shaped or sheet-shaped recording media. Furthermore, the disclosure concerns a digital printer to determine the toner concentration.

In such digital printers, a latent charge image of a charge image carrier is inked by means of electrophoresis with the aid of a liquid developer. The toner image that is created in such a manner is transferred indirectly (via a transfer element) or directly to the recording material. The liquid developer has toner particles and carrier fluid in a desired ratio. Mineral oil is advantageously used as a carrier fluid. In order to provide the toner particles with an electrostatic charge, charge control substances are added to the liquid developer. Further additives are additionally added, for example in order to achieve the desired viscosity or a desired drying behavior of the liquid developer.

Such digital printers have been known for a long time, for example from DE 10 2010 015 985 A1, DE 10 2008 048 256 A1 or DE 10 2009 060 334 A1.

From the document DE 10 2008 047 196 A1 by the same applicant, a method is known to determine the concentration of toner particles for a liquid developer system in which the suspension of carrier fluid and toner particles is charged with ultrasonic pulses. To determine the toner concentration, the travel time of the ultrasonic pulses is measured in a measurement cell, wherein a delay time period is initially determined from the digital clock signal of a microcomputer. After the delay time has elapsed, a capacitor is charged with a voltage until a first zero crossing of the signal received by the ultrasonic receiver takes place. The travel time of the ultrasonic pulses is determined with high resolution from the sum of delay period and charging time, and the toner concentration is concluded from this. The method described in this document has proven itself in practice; however, the determination of the toner concentration is strongly dependent on the temperature of the suspension. Moreover, the acoustic attenuation (which changes given a change of the toner concentration) affects the receiver signal, and the detection of the zero crossing of the attenuated signal for precise travel time determination is difficult.

The document U.S. Pat. No. 7,570,893 B2 describes a method and a device to monitor a developer fluid in order to therefore determine the temperature and the toner concentration of the developer fluid. The sound velocity and the attenuation of the developer fluid are measured with the aid of an ultrasound sensor, wherein both variables are dependent to different degrees on the temperature, such that the temperature can be calculated from both measurement variables. The attenuation of the ultrasonic wave is calculated from the ratio of the amplitudes of a first freely propagating ultrasonic wave and a second, reflected ultrasonic wave.

SUMMARY

It is an object to specify a method and a digital printer operated with a liquid developer, in which method and printer the toner concentration can be determined with high precision in a large variation range.

In a method or digital printer to print a recording material with toner particles applied with a liquid developer, toner concentration of the liquid developer is determined via measurement with aid of ultrasonic pulses. At least one ultrasonic pulse is generated by discharging an ultrasound emitter charged with a charge voltage. The ultrasonic pulse permeates the liquid developer and is received by an ultrasound receiver which generates a reception signal corresponding to the received ultrasonic pulse. With a control device, the charge voltage is regulated to a value such that a representative value of the reception signal corresponds to a predetermined desired value. The toner concentration is determined from the regulated charge voltage.

DESCRIPTION OF PREFERRED EXEMPLARY EMBODIMENTS

Figure 1:
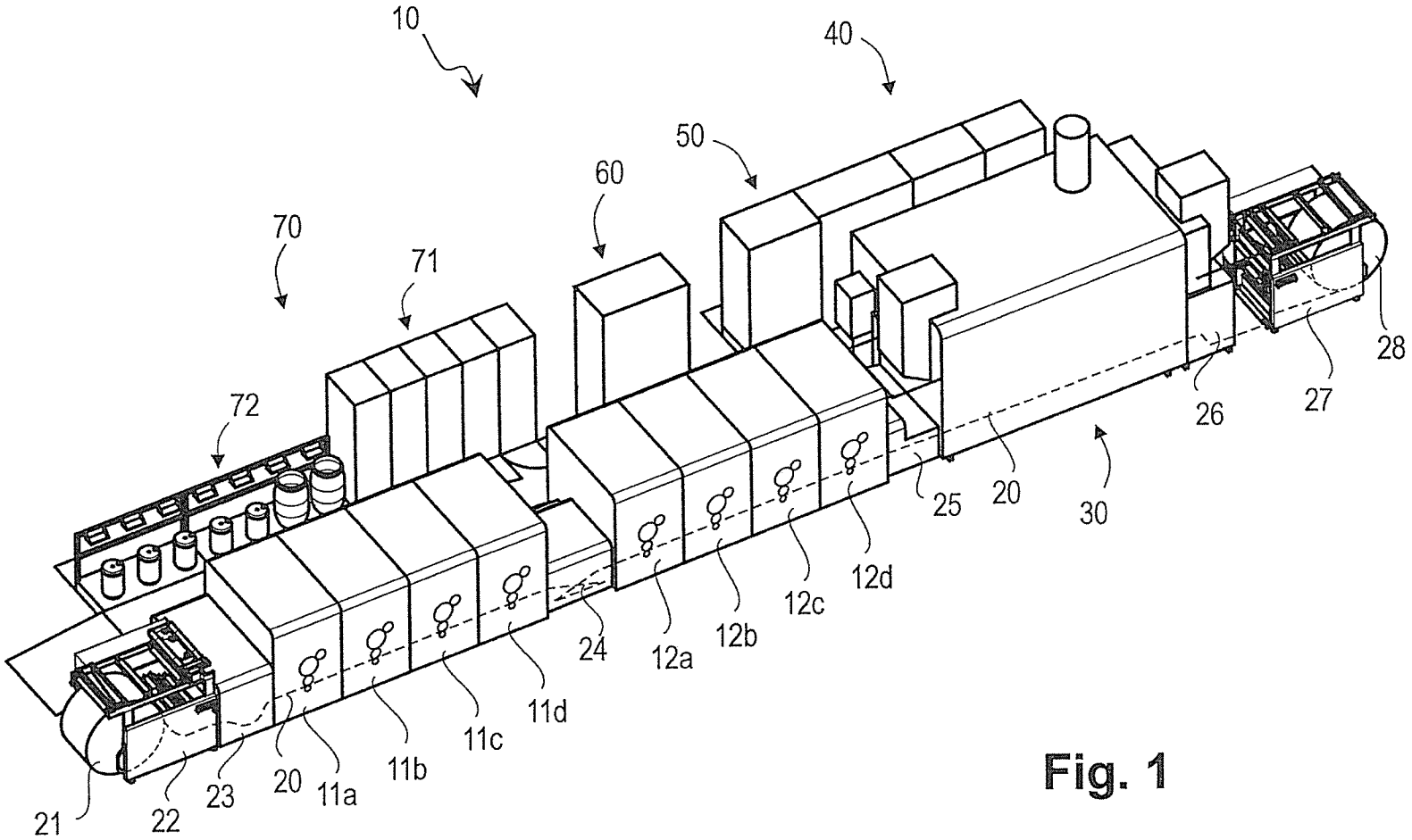
FIG. 1 is a view of a digital printer in an exemplary configuration of the digital printer.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

In one exemplary embodiment, the developer fluid is charged with ultrasonic pulses in a measurement cell. An ultrasonic pulse permeates the developer fluid and is thereby attenuated due to the attenuation effect of the toner particles present in the developer fluid. The attenuated ultrasonic pulse is received by an ultrasound receiver that generates an input signal (generally a voltage) corresponding to the received ultrasonic pulse. For example, piezoceramic elements are used as ultrasound transmitters and ultrasound receivers, which piezoceramic elements deform via application of an electrical voltage due to the piezo-effect, which serves to generate an ultrasonic wave. Such a piezoceramic can likewise serve as an ultrasound receiver that, upon deformation by the ultrasonic wave, generates a charge—and therefore an electrical voltage—as a receiver signal.

The pulse level of the ultrasonic pulse generated by the ultrasound transmitter depends on a charge voltage. The higher this charge voltage, the higher the pulse level. Upon traversal of the developer fluid, the pulse level of the ultrasonic wave is weakened as a result of the attenuation (affected by the toner concentration) and generates a corresponding reception signal in the ultrasound receiver. This reception signal (for example a voltage signal) is distorted relative to the ultrasonic pulse due to the frequency response of the ultrasound receiver and typically exists in the form of a decaying voltage oscillation train. In the exemplary embodiment, a control device is used that regulates the charge voltage acting on the ultrasound transmitter to a value such that a representative value of the reception signal corresponds to a predetermined desired value. For example, the peak value of the decaying oscillation train can be used as a representative variable. Other representative values would be, for example, the absolute value of the oscillation train, the effective value or the level of the first or second maximum or minimum etc. The control device thus compensates for the attenuation that the ultrasonic pulse experiences upon crossing through the developer fluid. A high charge voltage indicates a high attenuation, and therefore a high toner concentration; a low charge voltage indicates a low attenuation and a low toner concentration. Via calibration, the toner concentration can be determined from the charge voltage for a defined liquid developer in volume % or mass % within a relatively large measurement range.

Due to the regulation, a technical advantage results that the reception signal varies in a range around the desired volume at the receiver, whereby the reproducibility is improved. Interfering distortions at the reception signal (for example via overmodulation) are reduced via the regulation. A significant advantage also lies in that a relatively small temperature dependency is provided via the evaluation of the attenuation that the liquid developer causes, which improves the precision of the toner concentration determination.

In a preferred exemplary embodiment of the method, in addition to the described attenuation determination the travel time of the ultrasonic pulse in the measurement cell is determined and taken into account in the determination of the toner concentration. In this way, two measurement methods that are independent of one another are evaluated to determine the toner concentration, such that a comparison of the two results can contribute to the plausibility control and interference resistance.

In particular, it is advantageous if the toner concentration is calculated from the sum of a first summand and a second summand, wherein the first summand is the toner concentration multiplied by a weighting factor, which toner concentration results under consideration of the regulated charge voltage; and the second summand results from the multiplication of a weighting factor with the toner concentration that results from the travel time measurement. In this exemplary embodiment, both measurement principles are thus combined with one another, wherein the division by the weighting factors is made. The sum of the weighting factors is advantageously equal to 1. Since both measurement methods are affected differently by the temperature of the liquid developer, a certain temperature independence of the result of the toner concentration can be achieved via suitable selection of the weighting factors.

According to a further aspect of the exemplary embodiment, a digital printer is specified to execute the method. The technical effects that can be achieved with the digital printer coincide with those described given the method.

Exemplary embodiments of the invention are explained in detail in the following using the schematic drawings.

According to FIG. 1, a digital printer 10 for printing a recording material 20 has one or more print groups 11*a*-11*d* and 12*a*-12*d* that print a toner image (print image 20'; see FIG. 2) on the recording material 20. As a recording material 20, as shown a web-shaped recording material 20 is unrolled from a roll 21 with the aid of an unroller 22 and supplied to the first print group 11*a*. In a fixing unit 30, the print image 20' is fixed on the recording material 20. The recording material 20 can subsequently be rolled up on a roller 28 with the aid of a take-up stand 27. Such a configuration is also designated as a roll-to-roll printer.

In the preferred configuration shown in FIG. 1, the web-shaped recording material 20 is printed in full color with four print groups 11*a* through 11*d* on the front side and with four print groups 12*a* through 12*d* on the back side (what is known as a 4/4 configuration). For this, the recording material 20 is unwound by the unroller 22 from the roll 21 and supplied via an optional conditioning group 23 to the first print group 11*a*. In the conditioning group 23, the recording material 20 can be pre-treated or coated with a suitable substance. Wax or chemically equivalent substances can advantageously be used as a coating substance (also designated as a primer).

This substance can be applied over the entire surface of the recording material 20—or only to the points of the recording material 20 that are to be printed later—in order to prepare the recording material 20 for the printing and/or to affect the absorption response of the recording material 20 upon application of the print image 20'. It is therefore prevented that the later applied toner particles or the carrier fluid do not penetrate too significantly into the recording material 20, but rather essentially remain on the surface (color quality and image quality are thereby improved).

The recording material 20 is subsequently initially supplied in order to the first print groups 11*a* through 11*d* in which only the front side is printed. Each print group 11*a*-11*d* typically prints the recording material 20 in a different color, or also with different toner material (for example MICR toner, which can be read electromagnetically).

After the printing of the front side, the recording material 20 is turned in a turning unit 24 and supplied to the remaining print groups 12*a*-12*d* to print the back side. An additional conditioning group (not shown) can optimally be arranged in the region of the turning unit 24, via which the recording material 20 is prepared for the printing of the back side, for example a fixing (partial fixing) or other conditioning of the previously printed front side print image (or the entire front side or back side as well). It is thus prevented that the front side print image is mechanically damaged upon additional transport through the subsequent print groups.

In order to achieve a full-color printing, at least four colors (and therefore at least four print groups 11, 12) are required, namely the primary colors YMCK (yellow, magenta, cyan and black), for example. Additional print groups 11, 12 with special colors (for example customer-specific colors or additional primary colors in order to expand the printable colors space) can also be used.

Arranged after the print group 12*d* is a registration unit 25 via which registration marks that are printed on the recording material 20 independently of the print image 20' (in particular outside of the print image 20') are evaluated. The transversal and longitudinal register (the primary color points that form a color point should be arranged over one another or spatially very closely adjacent to one another; this is also designated as color register or four-color register) and the register (front side and back side must spatially coincide precisely) can thereby be adjusted so a qualitatively good print image 20' is achieved.

Arranged after the registration unit 25 is the fixing unit 30 via which the print image 20' is fixed on the recording material 20. In electrophoretic digital printers, a thermo-dryer is advantageously used as a fixing unit 30 that largely evaporates the carrier fluid so that only the toner particles remain on the recording material 20. This occurs under the effect of heat. The toner particles on the recording material 20 can thereby also be fused insofar as they have a material (resin, for example) that can be fused as the result of a heating effect.

Arranged after the fixing unit 30 is a feed group 26 that pulls the recording material 20 through all print groups 11*a*-12*d* and the fixing unit 30 without an additional drive being arranged in this region. The danger that the print image 20' that has not yet been fixed could be smeared would exist due to a friction feed for the recording material 20.

The feed group supplies the recording material 20 to the take-up stand 27 that rolls up the printed recording material 20.

Centrally arranged in the print groups 11, 12 and the fixing unit 30 are all supply devices for the digital printer 10, such as climate control modules 40, power supply 50, controller 60, modules for fluid management 70, fluid control unit 71 and storage reservoir 72 of the different fluids. In particular, pure carrier fluid, highly concentrated liquid developer (high proportion of toner particles in relation to the carrier fluid) and serum (liquid developer plus charge control substances) are required as liquids in order to supply the digital printer 10, as well as waste reservoirs for liquids to be disposed of or containers for carrier fluid.

The digital printer 10 is of modular design with its structurally identical print groups 11, 12. The print groups 11, 12 do not differ mechanically, but rather only in the liquid developers that are to be used in them (toner color or toner type).

Figure 2:
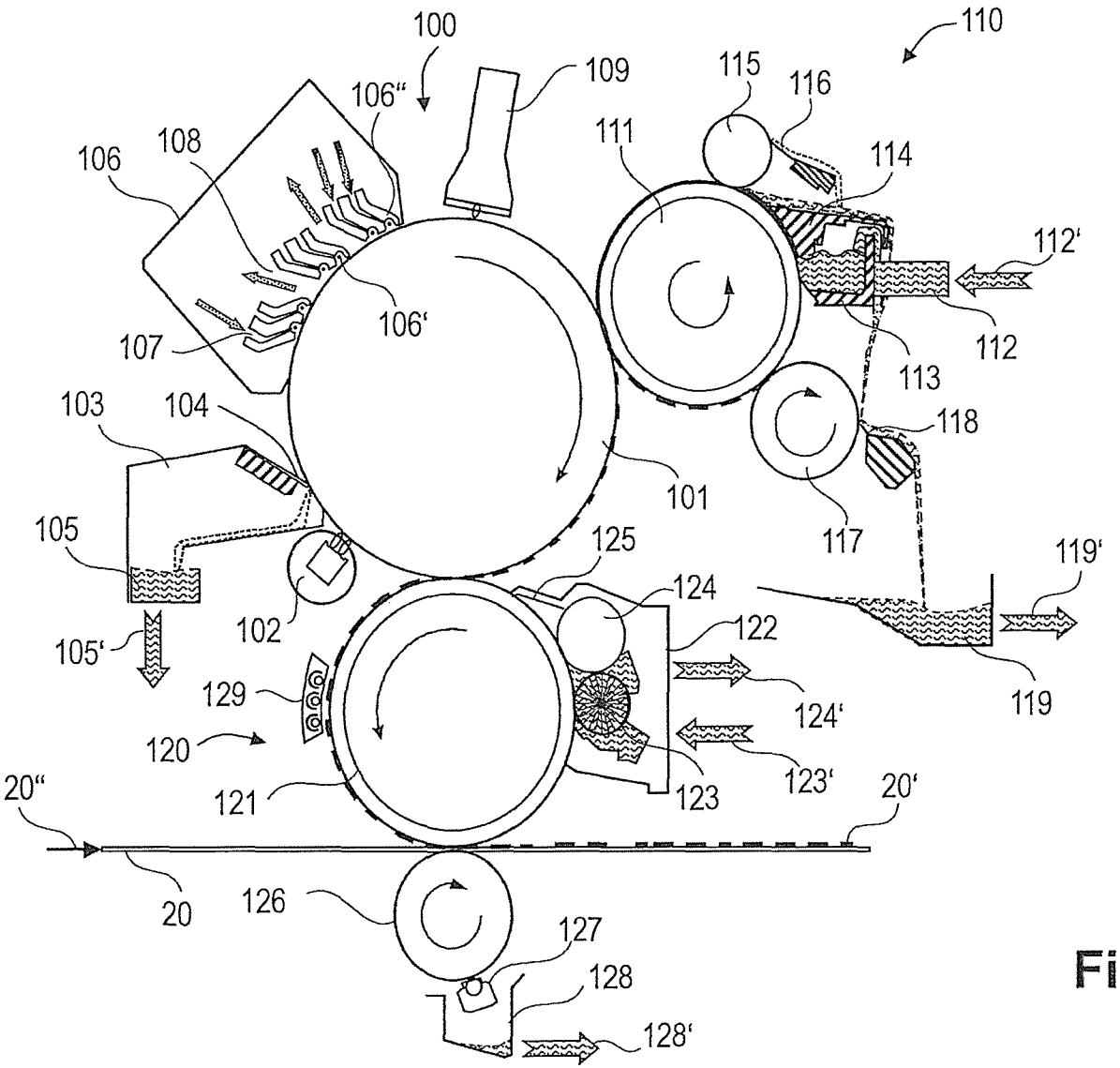
FIG. 2 is a schematic design of a print group of the digital printer according to FIG. 1.

The design of a print group 11, 12 in principle is shown in FIG. 2. Such a print group is based on the electrophotographic principle, in which a photoelectric image carrier is inked with charged toner particles with the aid of a liquid developer and the image that is created in such a manner is transferred to the recording material 20.

The print group 11, 12 essentially comprises an electrophotography station 100, a developer station 110 and a transfer station 120.

The core of the electrophotography station 100 is a photoelectric image carrier that has on its surface a photoelectric layer (what is known as a photoconductor). Here the photoconductor is designed as a roller (photoelectric roller 101) and has a hard surface. The photoelectric roller 101 rotates past the various elements to generate a print image 20' (rotation in the direction of the arrow).

The photoconductor is initially cleaned of all contaminants. For this, an erasing light 102 is present that erases charges that still remain on the surface of the photoconductor. The erasing light 102 can be coordinated (locally adjusted) in order to achieve a homogeneous light distribution. The surface can therefore be pre-treated uniformly.

After the erasing light 102, a cleaning device 103 mechanically cleans off the photoconductor in order to remove toner particles (possibly dirt particles) and remaining carrier fluid that are possibly still present on the surface of the photoconductor. The cleaned-off carrier fluid is supplied to a collection reservoir 105. The collected carrier fluid and toner particles are prepared (possibly filtered) and supplied depending on the color to a corresponding liquid color storage, i.e. to one of the storage reservoirs 72 (see arrow 105').

The cleaning device 103 advantageously has a blade 104 that rests on the generated surface of the photoconductor roller 101 at an acute angle (for instance 10° to 80° relative to the outlet surface) in order to mechanically clean off the surface. The blade 104 can move back and forth transverse to the rotation direction of the photoconductor roller 101 in order to clean the generated surface with as little wear as possible on the entire axial length.

The photoconductor is subsequently charged by a charging device 106 to a predetermined electrostatic potential. Multiple corotrons (in particular glass shell corotrons) are advantageously present for this. The corotrons comprise at least one wire 106' at which a high electrical voltage is present. The air around the wire 106' is ionized by the voltage. A shield 106" is present as a counter-electrode. The corotrons are additionally flushed with fresh air that is supplied via special air channels (air feed channel 107 for ventilation and exhaust channel 108 to exhaust) between the shields (see also air flow arrows in FIG. 2). The supplied air is then ionized uniformly at the wire 106'. A homogeneous, uniform charge of the adjacent surface of the photoconductor is thereby achieved. The uniform charge is further improved with dry and heated air. Air is discharged via the exhaust channels 108. Ozone that is possibly created can likewise be drawn off via the exhaust channels 108.

The corotrons can be cascaded, meaning that two or more wires 106' are then present per shield 106" given the same shield voltage. The current that flows across the shield 106" can be adjusted, and the charge of the photoconductor can thereby be controlled. The corotrons can be fed with different amounts of current in order to achieve a uniform and sufficiently high charge at the photoconductor.

Arranged after the charging device 106 is a character generator 109 that discharges the photoconductor per pixel via optical radiation, depending on the desired print image 20'. A latent image is thereby created that is inked later with toner particles (the inked image corresponds to the print image 20'). An LED character generator 109 is advantageously used in which an LED line with many individual LEDs is arranged stationary over the entire axial length of the photoconductor roller 101. Among other things, the number of LEDs and the size of the optical image points on the photoconductor determine the resolution of the print image 20' (typical resolution is 600×600 dpi). The LEDs can be controlled individually in terms of time and with regard to their radiation power. Multilevel methods can thus be applied to generate raster points (comprising multiple image points or pixels), or image points are time-delayed in order to implement corrections electro-optically, for example given uncorrected color registration or register.

The character generator 109 has a control logic that must be cooled, due to the plurality of LEDs and their radiation power. The character generator 109 is advantageously liquid-cooled. The LEDs can be activated per group (multiple LEDs assembled into a group) or separately from one another.

The latent image generated by the character generator 109 is inked with toner particles by the developer station 110. For this the developer station 110 has a rotating developer roller 111 that directs a layer of liquid developer towards the photoconductor (the functionality of the developer station 110 is explained in detail further below). Since the surface of the photoconductor roller 101 is relatively hard, the surface of the developer roller 111 is relatively soft, and the two are pressed against one another; a thin, high nip (a gap between the rollers) is created in which the charged toner particles migrate electrophoretically from the developer roller 111 to the photoconductor at the image points due to an electrical field. In the non-image points, no toner transfers to the photoconductor. The nip filled with liquid developer has a height (thickness of the gap) that is dependent on the mutual pressure of the two rollers 101, 111 and the viscosity of the liquid developer. The width of the nip typically lies in the range greater than approximately 2 μm to approximately 20 μm (the values can also change depending on the viscosity of the liquid developer). The length of the nip amounts to a few millimeters, for instance.

The inked image rotates with the photoconductor roller 111 up to a first transfer point at which the inked image is essentially transferred completely to a transfer roller 121. The transfer roller 121 moves to the first transfer point (nip between photoconductor roller 101 and transfer roller 121) in the same direction, and advantageously with identical velocity as the photoconductor roller 101. After the transfer of the print image 20' to the transfer roller 121, the print image 20' (toner particles) can optionally be recharged or charged by means of a charging unit 129 (a corotron, for example) in order to be able to subsequently transfer the toner particles better to the recording material 20.

The recording material 20 runs through between the transfer roller 121 and a counter-pressure roller 126 in the transport direction 20". The contact region (nip) represents a second transfer point in which the toner image is transferred to the recording material 20. In the second transfer region, the transfer roller 121 moves in the same direction as the recording material 20. The counter-pressure roller 126 rotates in this direction in the region of the nip. The velocities of the transfer roller 121, the counter-pressure roller 126 and the recording material 20 are matched to one another at the transfer point and are advantageously identical, such that the print image 20' is not smeared. At the second transfer point, the print image 20' is transferred electrophoretically to the recording material 20 due to an electrical field between the transfer roller 121 and the counter-pressure roller 126. Moreover, the counter-pressure roller 126 presses with high mechanical force against the relatively soft transfer roller 121, whereby the toner particles remain stuck to the recording material 20 due to the adhesion.

Since the surface of the transfer roller 121 is relatively soft and the surface of the counter-pressure roller 126 is relatively hard, a nip is created upon unrolling, in which nip the toner transfer occurs. Irregularities in the thickness of the recording material 20 can therefore be equalized, such that the recording material 20 can be printed without gaps. Such a nip is also well suited to print thicker or more uneven recording media 20, for example as is the case in the printing of packaging.

The print image 20' should in fact transfer to the recording material 20; nevertheless, a few toner particles can nevertheless undesirably remain on the transfer roller 121. A portion of the cleaning fluid always remains on the transfer roller 121 as a result of the wetting. The toner particles that are possibly still present should be nearly entirely removed by a cleaning unit 122 following the second transport point. The cleaning fluid that is still located on the transfer roller 121 can also be completely removed from the transfer roller 121, or be removed up to a predetermined layer thickness, so that identical conditions prevail after the cleaning unit 122 and before the first transfer point from the photoconductor roller 101 to the transfer roller 121 due to a clean surface or a defined layer thickness with liquid developer on the surface of the transfer roller 121.

This cleaning unit 122 is advantageously designed as a wet chamber with a cleaning brush 123 and a cleaning roller 123. In the region of the brush 123, cleaning fluid (for example carrier fluid or a separate cleaning fluid are used) is supplied via a cleaning fluid supply 123'. The cleaning brush 123 rotates in the cleaning fluid and thereby "brushes" the surface of the transfer roller 121. The toner adhering to the surface is thereby loosened.

The cleaning roller 124 lies at an electrical point in time that is opposite the charge of the toner particles. As a result of this, the electrically charged toner is removed from the transfer roller 121 by the cleaning roller 124. Since the cleaning roller 123 touches the transfer roller 121, it also removes cleaning fluid remaining on the transfer roller 121, together with the supplied cleaning fluid. A conditioning element 125 is arranged at the outlet from the wet chamber. As shown, a retention plate can be used as a conditioning element 125, which retention plate is arranged at an obtuse angle (for instance between 100° and 170° between plate and outlet surface) relative to the transfer roller 121, whereby residues of fluid on the surface of the roller are nearly completely retained in the wet chamber and are supplied to the cleaning roller 124 for removal via a cleaning fluid discharge 124' to a cleaning fluid reservoir (in the storage reservoirs 72) that is not shown.

Instead of the retention plate, a dosing unit (not shown) can also be arranged there that, for example, has one or more dosing rollers. The dosing rollers have a predetermined clearance from the transfer roller 121 and receive so much cleaning fluid that a predetermined layer thickness arises after the dosing rollers as a result of the squeezing. The surface of the transfer roller 121 is then not completely cleaned off; cleaning fluid of a predetermined layer thickness thus remains over the entire surface. Removed cleaning fluid is directed via the cleaning roller 124 back to the cleaning fluid storage reservoir.

The cleaning roller 124 itself is mechanically kept clean via a blade (not shown). Fluid that is cleaned off—including toner particles—is captured for all colors via a central collection reservoir, cleaned and supplied to the central cleaning fluid storage reservoir for reuse.

The counter-pressure roller 126 is likewise cleaned via a cleaning unit 127. As a cleaning unit 127, a blade, a brush and/or a roller can remove contaminants (paper dust, toner particle residues, liquid developer etc.) from the counter-pressure roller 126. The cleaned fluid is collected in a collection container 128 and provided again to the printing process (possibly cleaned) via a fluid discharge 128'.

In the print groups 11 that print the front side of the recording material 20, the counter-pressure roller 126 presses against the unprinted side (and thus the side that is still dry) of the recording material 20.

Nevertheless, dust/paper particles or other dirt particles can already be located on the dry side that are then removed from the counter-pressure roller 126. For this, the counter-pressure roller 126 should be wider than the recording material 20. As a result of this, contaminants can also be cleaned off well outside of the printing region.

In the print groups 12 that print to the back side of the recording material 20, the counter-pressure roller 126 presses directly on the damp print image 20' of the front side that has not yet been fixed. So that the print image 20' is not removed by the counter-pressure roller 126, the surface of the counter-pressure roller 126 must have anti-adhesion properties with regard to toner particles and also with regard to the carrier fluid on the recording material 20.

The developer station 110 inks the latent print image 20' with a predetermined toner. For this, the developer roller 111 directs toner particles towards the photoconductor. In order to ink the developer roller 111 itself with a layer over its entire area, liquid developer is initially supplied to a storage chamber from a mixing container (within the fluid control unit 71; not shown) via a fluid feed 112' with a predetermined concentration. Given a surplus, the liquid developer is supplied from this reservoir chamber 112 to a pre-chamber 113 upon overflow (a type of pan that is open at the top). An electrode segment 114 that forms a gap between itself and the developer roller 111 is arranged towards said developer roller 111.

The developer roller 111 rotates through the pre-chamber 113 (open at the top) and thereby carries liquid developer along into the gap. Excess liquid developer runs from the pre-chamber 113 back to the reservoir chamber 112.

Due to the electrical field formed by the electrical point in time between the electrode segment 114 and the developer roller 11, in the gap the liquid developer is divided into two regions, and in fact into a layer region in proximity to the developer roller 111 in which the toner particles concentrate (concentrated liquid developer) and a second region in proximity to the electrode segment 114 that is low in toner particles (very low concentration of liquid developer.

The layer of liquid developer is subsequently transported further to a dosing roller 115. The dosing roller 115 squeezes the upper layer of the liquid developer so that a defined layer thickness of liquid developer of approximately 5 μm subsequently remains on the developer roller 111. Since the toner particles are significantly located near the surface of the developer roller 111 in the carrier fluid, the outlying carrier fluid is significantly squeezed out or retained and ultimately is supplied to a collection container 119, but not to the storage container 112.

As a result of this, predominantly highly concentrated liquid developer is conveyed through the nip between dosing roller 115 and developer roller 111. A uniformly thick layer of liquid developer with approximately 40 percent carrier fluid by mass thus arises after the dosing roller 115 (the mass ratios can also fluctuate more or less depending on the printing process requirements). This uniform layer of liquid developer is transported into the nip between the developer roller 111 and the photoconductor roller 101. There the image points of the latent image are then electrophoretically inked with toner particles, while no toner passes to the photoconductor in the region of the non-image points. Sufficient carrier fluid is absolutely necessary for electrophoresis. The fluid film splits approximately in the middle after the nip as a result of wetting, such that one part of the layer remains adhered to the surface of the photoconductor roller 101 and the other part (essentially carrier fluid for image points and essentially toner particles and carrier fluid for non-image points) remains on the developer roller 111.

So that the developer roller 111 can be coated again with liquid developer under the same conditions and uniformly, toner particles (these essentially represent the negative, untransferred print image) will remain, and liquid developer with be electrostatically and mechanically removed by a cleaning roller 117. The cleaning roller 117 itself is cleaned by a blade 118. The cleaned-off liquid developer is supplied to the collection container 119 for re-use, to which the liquid developer cleaned off of the dosing roller 115 (by means of a blade 116, for example) and the liquid developer cleaned off of the photoconductor roller 101 by means of the blade 104 are also supplied.

The liquid developer collected in the collection container 119 is supplied to the mixing container via the liquid discharge 119'. Fresh liquid developer and clean carrier fluid are also supplied as needed to the mixing container. Sufficient liquid in a desired concentration (predetermined ratio of toner particles to carrier fluid) must always be present in the mixing container. The concentration in the mixing container is continuously measured and regulated accordingly depending on the supply of the amount of cleaned-off liquid developer and its concentration, as well as of the amount and concentration of fresh liquid developer or, respectively, carrier fluid.

For this, the most highly concentrated liquid developer, pure carrier fluid, serum (carrier fluid and charge control substances in order to control the charge of the toner particles) and cleaned-off liquid developer can be separately supplied to this mixing container from the corresponding storage reservoirs 72.

The photoconductor can preferably be designed in the form of a roller or as a continuous belt. An amorphous silicon can thereby be used as a photoconductor material or an organic photoconductor material (also designated as an OPC).

Instead of a photoconductor, other image carriers (such as magnetic, ionizable etc. image carriers) can also be used that do not operate according to the photoelectric principle, but rather which will electrically, magnetically or otherwise impress latent images according to other principles, which images are then inked and ultimately transferred to the recording material 20.

LED lines or even lasers with corresponding scan mechanism can be used as a character generator 109.

The transfer element can likewise be designed as a roller or as a continuous belt. The transfer element can also be omitted. The print image 20' is then directly transferred from the photoconductor roller 101 to the recording material 20.

What is to be understood by the term "electrophoresis" is the migration of the charged toner particles in the carrier fluid as a result of the action of an electrical field. At each transfer of toner particles, the corresponding toner particles essentially completely pass to a different element. After contacting the two elements, the fluid film is approximately split in half as a result of the wetting of the participating elements, such that approximately one half remains adhered to the first element and the remaining part remains adhered to the other element. The print image 20' is transferred and then transported further in the next part in order to allow an electrophoretic migration of the toner particles again in the next transfer region.

The digital printer 10 can have one or more print groups for the front side printing and (if applicable) one or more print groups for the back side printing. The print groups can be arranged in a line, L-shaped or U-shaped.

Instead of the take-up stand 27, post-processing devices (not shown) can also be arranged after the feed group 26, such as cutters, folders, stackers etc. in order to bring the recording material 20 into the final form. For example, the recording material 20 could be processed so far that a finished book is created at the end. The post-processing apparatuses can likewise be arranged in series or curved away from this.

As was previously described as a preferred exemplary embodiment, the digital printer 10 can be operated as a roll-to-roll printer. It is also possible to cut the recording material 20 into sheets at the end and to subsequently stack the sheets, or to further process them in a suitable manner (roll-to-sheet printer). It is likewise possible to feed a sheet-shaped recording material 20 to the digital printer 10, and to stack the sheets or process them further at the end (sheet-to-sheet printer).

If only the front side of the recording material 20 is printed, at least one print group 11 with one color is thus required (simplex printing). If the back side is also printed, at least one print group 12 is also required for the back side (duplex printing). Depending on the desired print image 20' on the front side and back side, the printer configuration includes a corresponding number of print groups for front side and back side, wherein every print group 11, 12 is always designed for only one color or one type of toner.

The maximum number of print groups 11, 12 is only technically dependent on the maximum mechanism draw load of the recording material 20 and the free feed length. Arbitrary configurations are typically possible, from a 1/0 configuration (only one print group for the front side to be printed) to a 6/6 configuration in which six print groups can respectively be present for the front side and back side of the recording material 20. The preferred embodiment (configuration) is shown in FIG. 1 (a 4/4 configuration), with which full-color printing with the four primary colors is produced for the front side and back side. The order of the print groups 11, 12 in four-color printing advantageously proceeds from a print group 11, 12 that prints in light color (yellow) to a print group 11, 12 that prints in dark color, thus for example that prints the recording material 20 in the color order Y-C-M-K from light to dark.

The recording material 20 can be produced from paper, metal, plastic or other suitable and printable materials.

Figure 3:
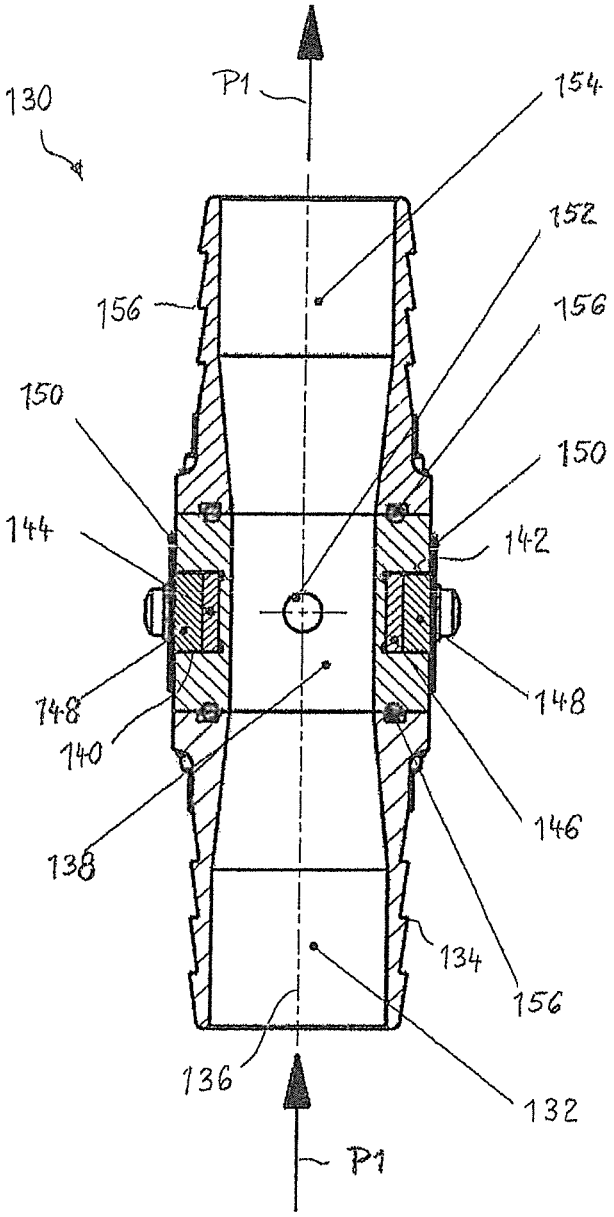
FIG. 3 is a measurement cell to determine the toner concentration.

As is explained further above, it is important that the toner concentration in the liquid developer is continuously monitored and must be regulated to a predetermined value, because this toner concentration has a strong influence on the achievable inking of the latent image on the photoconductor (and therefore also on the print quality). An important component of an arrangement to determine the toner concentration in the liquid developer is a measurement cell 130, of which a principle representation is shown in cross section in FIG. 3. The measurement cell 130 comprises an entrance cap 132 whose rotationally symmetrical internal space is optimized for flow. The outer surface of the entrance cap 132 has ribs 134 for attachment of a hose (not shown). The liquid developer flows in the vertical direction from the bottom upward, corresponding to arrow P1. During operation the measurement cell 130 is arranged so that its longitudinal axis 136 is situated vertically, such that during operation the inside of said measurement cell 130 is actively flushed by the carrier fluid with the toner particles. Given this flow direction it is avoided that air bubbles that are possibly present can remain within the measurement cell 130 since they are flushed out from the internal space of the measurement cell 130 via the common direction of the upward force of the air bubbles and current.

The middle part of the measurement cell 130 forms a sensor body 138 that is produced from a sound-attenuating plastic. This sensor body 138 has a rectangular internal cross section and a respective recess 140, 142 on opposite sides, in which recesses are attached piezoceramic elements 144, 146. Disc-shaped piezoceramic elements are advantageously used that are adhered with a two-component adhesive (for example the epoxy adhesive Locktite 9497 from the company Henkel). The adhesive serves to produce an advantageous sound coupling. The piezoceramic element 144 serves as a transmitter; the piezoceramic element 146 serves as a receiver. Contact pressure plates 148 made of sound-attenuating plastic press the piezoceramic elements 144, 146 into the recesses 140 or, respectively, 142 and are held on their outsides by diaphragms. The material remaining below the recess 140 or 142 and inside the measurement cell 130 serves as a sound membrane and is designed to be relatively thin. A temperature sensor that measures the temperature of the liquid developer is arranged in a bore 152, transversal to the propagation direction of the ultrasonic pulses between the piezoceramic elements 144, 146. As viewed in the flow direction P1, the sensor body 138 is connected with an exit cap 154 whose internal space is optimized for flow and that has on its outside ribs 156 for the attachment of hose (not shown). The entrance cap 132 and the exit cap 154 are sealed by sealing elements 156 (O-rings, for example) relative to the sensor body 138. The entrance cap 132 and the exit cap 154 form a flow-optimized transition to the rectangular cross section of the sensor body 138 and the respective connected circular cross section of the fluid line or the fluid hose.

Figure 4:
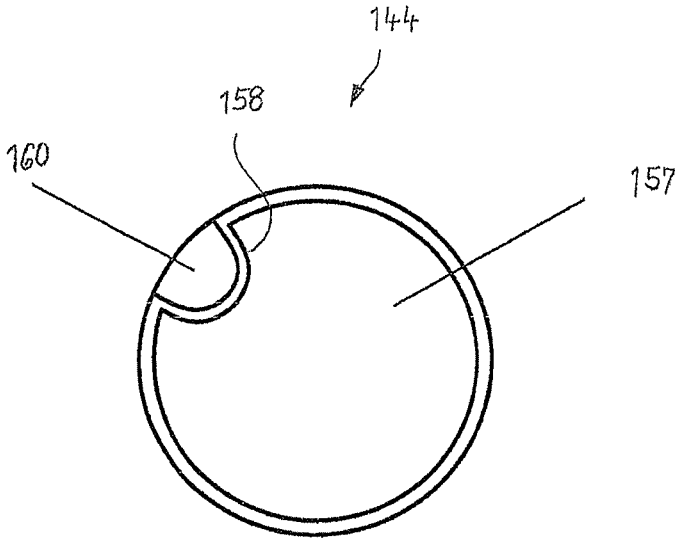
FIG. 4 is a disc-shaped piezoceramic element.

FIG. 4 shows a plan view of the piezoceramic element 144 that is structurally identical to the piezoceramic element 146. The piezoceramic element 144 is disc-shaped and coated on both sides with metal so that a voltage can be applied or, respectively, tapped between the metal layers. The metal layer 157 of the front side has a recessed segment 158 into which a metal contact 160 is arranged, which metal contact 160 is electrically insulated from said metal layer 157. This metal contact is connected with the back side metal layer (not shown) so that—as viewed from the front side—both metal layers that are insulated from one another by the piezoceramic element can be contacted. The piezoceramic element 144 typically has a diameter of 10 mm and is approximately 2 mm thick. A silver coating can be provided as a metal coating. As viewed from the front side, both metal layers can be contacted via soldering.

Figure 5:
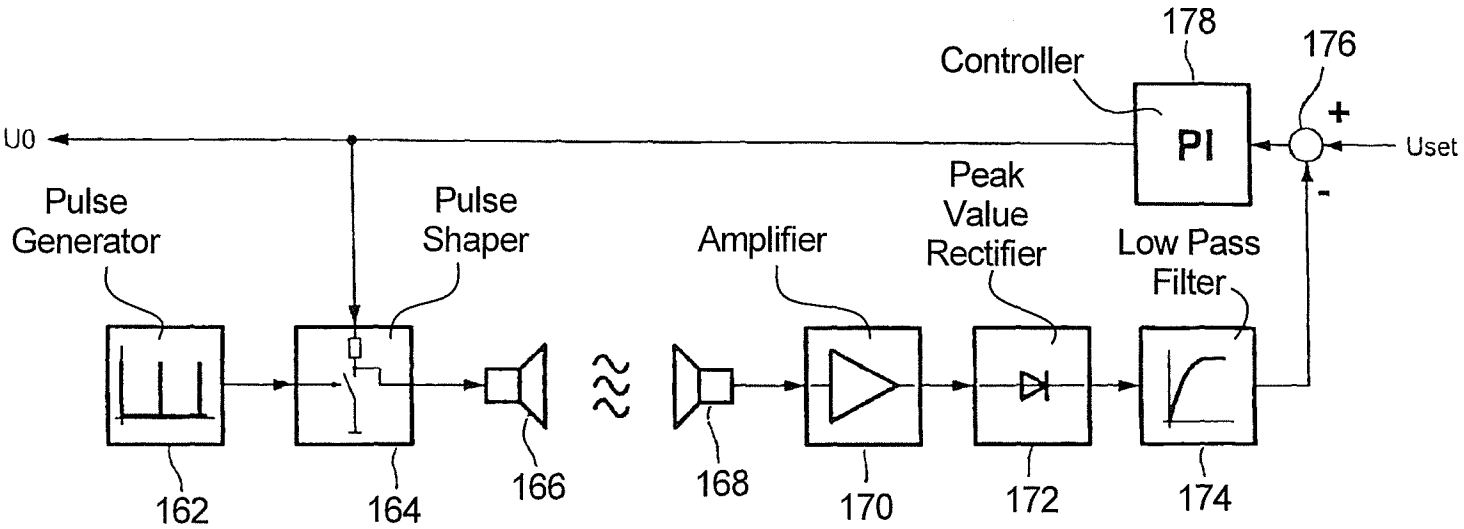
FIG. 5 is a block representation of an arrangement to determine the attenuation of ultrasonic pulses.

In a block presentation, FIG. 5 shows the design of an arrangement to determine the attenuation of ultrasonic pulses in the measurement cell 130. A pulse generator 162 generates periodic pulses to activate a pulse shaper 164 that controls the ultrasonic emitter (advantageously the piezoceramic element 144 according to FIG. 3) so that periodic ultrasonic pulses permeate the liquid developer in the measurement cell 130. The pulse generator 162 ideally generates short spike pulses that, for example, switch a fast semiconductor switch in the pulse shaper 164 and thus lead to a discharge of the piezoceramic element 144 that has previously been charged to a charge voltage U0. The amplitude of the emitted ultrasonic pulse is dependent on the charge voltage U0.

Upon traversing the measurement cell 130, the ultrasonic pulse is attenuated by the liquid depending on the concentration of the present solid particles (in the form of toner particles) and then arrives at the ultrasound receiver 168 (which is executed as a piezoceramic element 146 in the measurement cell 130). The ultrasound receiver 168 transduces the received pressure fluctuations into a voltage that corresponds (as a result of the frequency response of the ultrasound receiver 168) into a decaying oscillation train in the form of an alternating voltage. This alternating voltage is amplified by the following amplifier 170. The amplified signal is subsequently rectified by a peak value rectifier 172 and filtered in a lowpass filter 174. The peak value Us is then applied as a real value at the output of the lowpass filter 174. This real value is provided to an adder element 176 that calculates the difference from a desired value Uset and the real value as a control deviation RA. The control deviation RA is supplied to a controller 178 (for example a PI controller) that generates the control value in the form of the charge voltage U0.

For example, if the value Us is smaller than the desired value Uset, the charge voltage U0 is increased. The pulse amplitude of the ultrasonic pulse (and consequently also the peak value of the receiver signal) therefore also increases. Conversely, if the value Us is larger than the desired value Uset the charge voltage U0 is lowered, whereby the pulse amplitude of the emitted ultrasonic pulse is lower and thus the peak value of the receiver signal is also smaller. If the regulation has been engaged, the values U and Uset are equally large and a stable value of the charge voltage U0 is present. In the engaged state, the charge voltage U0 is high when the attenuation (and therefore the toner concentration) is high, and conversely the toner concentration is low when the attenuation is low. The charge voltage U0 is advantageously supplied to an analog/digital converter (not shown) and converted into a digital value. The attenuation of the liquid developer can be determined from this digital value via calibration, and the toner concentration can be determined due to the close correlation with the solid proportion.

Figure 6:
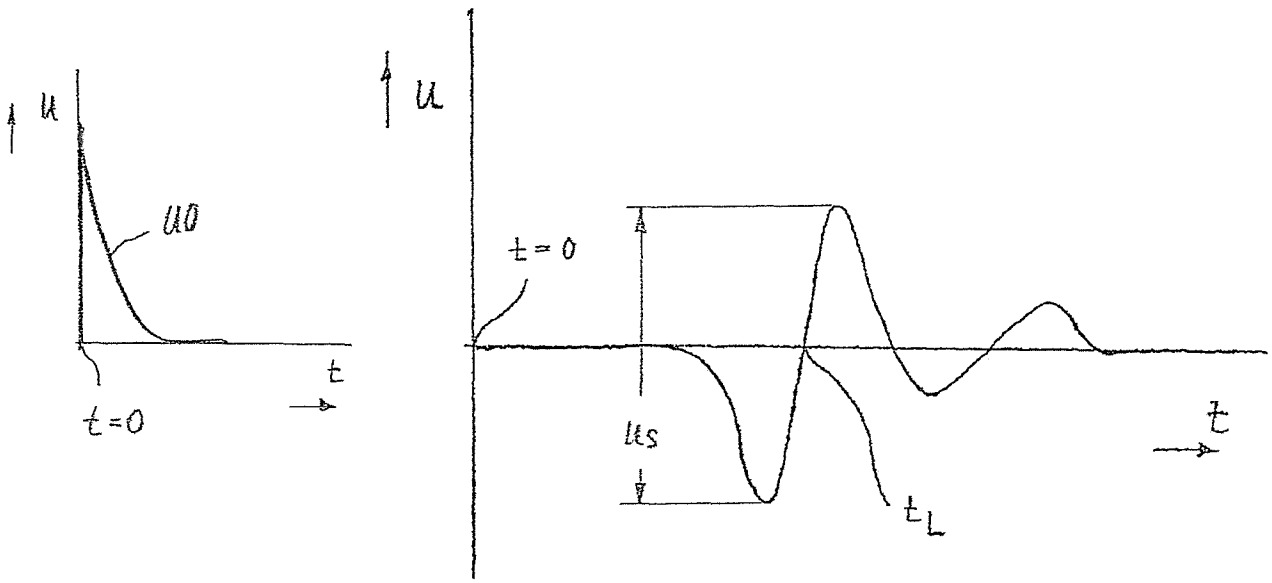
FIG. 6 shows voltage curves at the transmitter side and receiver side.

In the left image portion, FIG. 6 shows the signal curve of the charge voltage U0 over time t. The discharge process begins at the point in time t=0, and a deformation of the piezoceramic element 144 results due to the fast discharge, which deformation is introduced into the liquid inside the sensor body 138 via the remaining material wall in the sensor body 138. The ultrasonic pulse traverses the liquid and strikes the piezoceramic element 146, which serves as a ultrasound receiver 168. The pressure wave of the ultrasonic pulse deforms the piezoceramic element 146 so that an electric voltage arises due to charge displacement. The right image portion shows the voltage U arising at the piezoceramic element 146 over time t. As a result of the frequency response of the piezoceramic element 146, inherent oscillations are excited such that voltage U arising due to charge displacement corresponds to an attenuated alternating voltage oscillation train. The peak value rectifier 172, in connection with the subsequent lowpass filter 174, generates the peak value Us—in the present case as a peak-peak measurement value according to FIG. 6. The time $t_L$ up to reaching the first zero crossing of the minimum or, respectively, maximum of the oscillation train relative to the zero line (without receiver signal) serves as a measure of the travel time of the ultrasonic pulse. A typical value for $t_L$ is approximately 16 μs. Depending on the piezo-material that is used, the piezoceramic elements 144, 146 have an inherent resonance between 1 MHz and 10 MHz.

Figure 7:
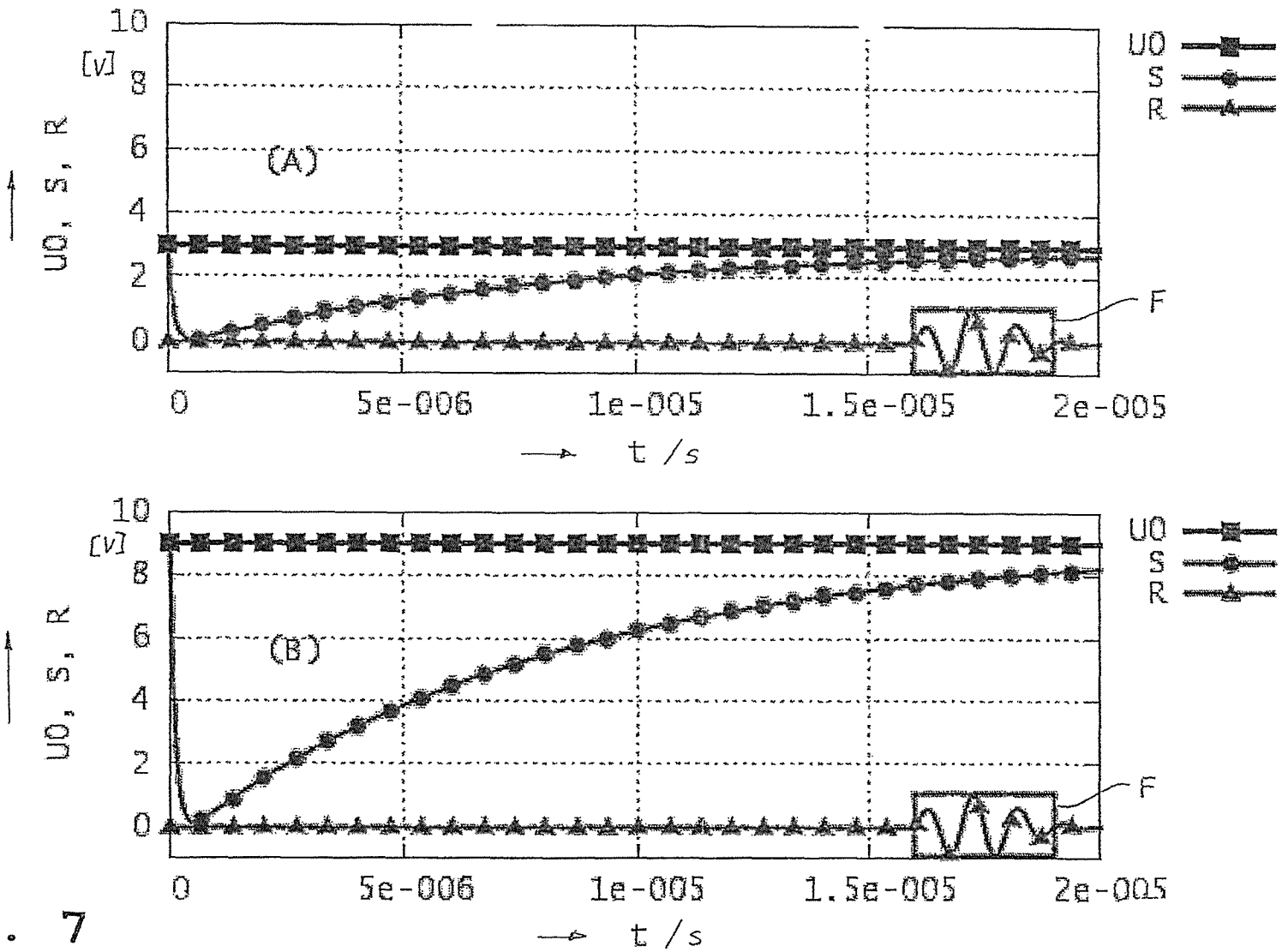
FIG. 7 illustrates curves of the charge voltage given different attenuations.

FIG. 7 shows time curves for the charge voltage U0 given two attenuations of different strength. The amplitude of the receiver signal R is measured with the peak value rectifier 172 and regulated by the controller 178 to a constant, predetermined desired value Uset. The receiver signal is indicated within the shown window F. The upper diagram A shows the case of a fluid with low attenuation. In this case, the controller 178 adjusts the charge voltage U0 to a value of 3 V. The piezoceramic element 144 charged to this voltage U0 is temporarily discharged to approximately 0 volts at the beginning (t=0) and thereby generates the ultrasound pulse. The piezoceramic element 144 subsequently charges again to the charge voltage U0 of 3 V, which is to be detected using the signal S. The ultrasonic pulse traverses the liquid and reaches the piezoceramic element 146 (thus the ultrasound receiver) after approximately 16 μs, where the generated voltage is amplified and measured as a receiver signal R.

The diagram B at the bottom of FIG. 7 shows the case of a liquid with high attenuation. In this case the controller 178 adjusts the charge voltage U0 to a value of approximately 9 V, for example. The initial voltage pulse at the piezoceramic element 144 (ultrasound emitter), and therefore the pulse level for the generated ultrasonic pulse, is accordingly higher in order to compensate for the higher attenuation of the liquid. As is clear in diagram B, the receiver signal R is approximately exactly as high as in case A because the controller compensates a deviation of the receiver signal R due to its control response. Via the charge voltage U0, the described regulation thus delivers a measure of the attenuation in the liquid developer, and therefore a measure of the toner concentration.

Figure 8:
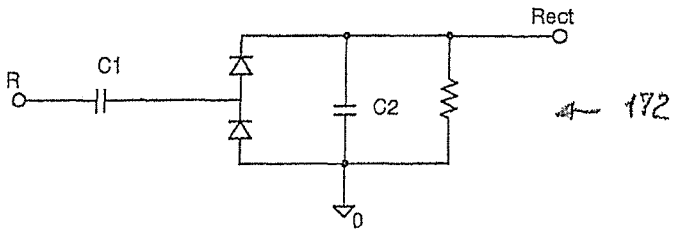
FIG. 8 illustrates an embodiment of a peak value rectifier.

FIG. 8 schematically shows an embodiment of the peak value rectifier 172. Two fast switching diodes and two capacitors C1, C2 form a voltage doubling circuit. In this arrangement, the voltage rectified at the output Rect is approximately twice as high as given a one-way rectification. The lowpass filtering results via the dimensioning of the components C1 and C2 in connection with the repetition frequency of the pulse generation in the pulse generator 162. At each incident ultrasonic pulse the capacitor C1 is charged, and this subsequently passes a portion of its charge to the capacitor C2, whose voltage increases with every newly arriving ultrasonic pulse. The increases takes place faster the more frequently that the ultrasonic pulses arrive. The smaller the ratio of the capacitance of C1 to C2, the slower the increase. A ratio of 1:20 has proven to be advantageous; ratios in the range between 1:10 and 1:100 are advantageous in practice overall. The capacitor C2 should be chosen to be so large that the discharge only occurs very slowly, wherein the discharge time constant should be significantly larger than the period duration of the pulse generation. The voltage Rect is advantageously only loaded by a high-resistance amplifier input.

Figure 9:
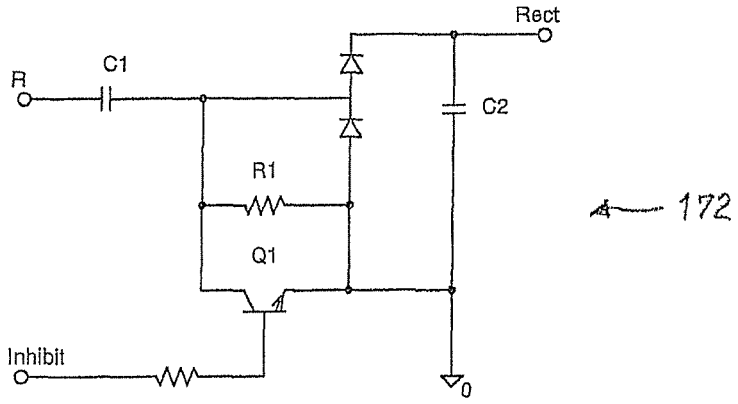
FIG. 9 illustrates a peak value rectifier with interference suppression.

FIG. 9 shows a further embodiment of the peak value rectifier in which additional measures for interference suppression have been introduced. The additional resistor R1, with the capacitor C1, forms a highpass filter that prevents low-frequency interference signals from adulterating the peak value Rect. The function of the rectification can be affected via the transistor switch Q1. A superordinate controller—for example a microcontroller—can short the signal R via the application of a positive voltage at the input "Inhibit", and therefore prevent the signal from contributing to the rectification. It is thereby possible to release the rectification only in specific time windows, for example only just before the arrival of the ultrasonic pulse at the ultrasound receiver. Interferences and signals outside of this time window then have barely any effect on the peak value Rect to be determined.

Figure 10:
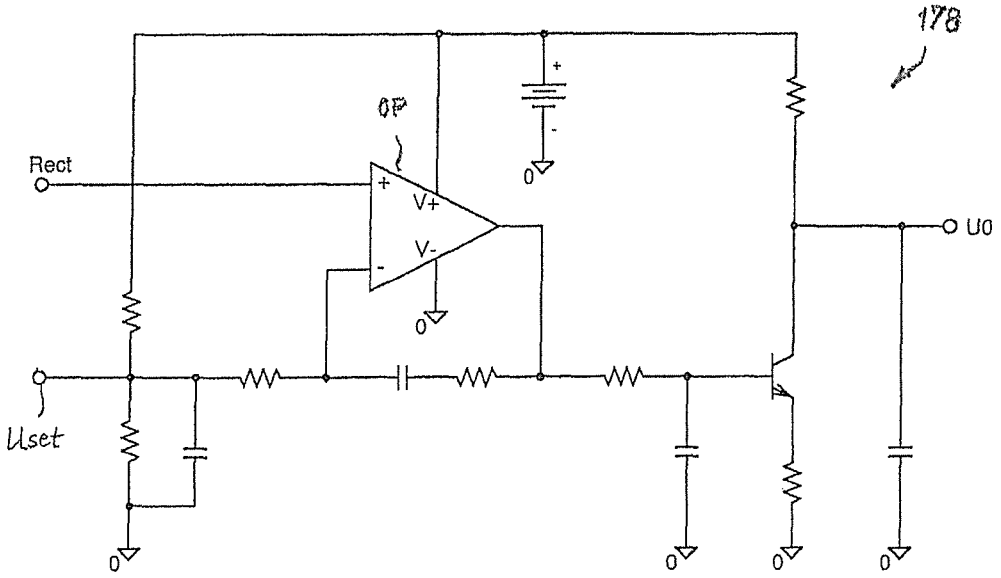
FIG. 10 shows a circuit example for the controller.

FIG. 10 shows an exemplary embodiment of the controller n178. A PI controller or a PID controller can be used to optimize the control response. The incorporation of the integral component (I-component) has the advantage that the control deviation RA can be exactly corrected to zero. The controller according to FIG. 10 is designed as an operational amplifier circuit. It compares the peak value Rect with a constant desired value Uset. If the value Rect is greater than Uset, the output voltage of the operational amplifier OP increases. The subsequent transistor becomes conductive and its collector current increases. The voltage at the collector thereby drops, which corresponds to the charge voltage U0. The pulse level of the emitter ultrasonic pulse (and therefore the receiver signal R at the receiver) is decreased by the reduction of U0 until the measured peak value Rect coincides with the constant value Uset. The value range of the charge voltage U0 is limited by the supply voltage and the dimensioning of the resistance at emitter and collector of the transistor. The cited regulation functions properly only so long as the charge voltage U0 does not reach one of the limits. The value of the charge voltage U0 should therefore be checked by a monitoring circuit.

Figure 11:
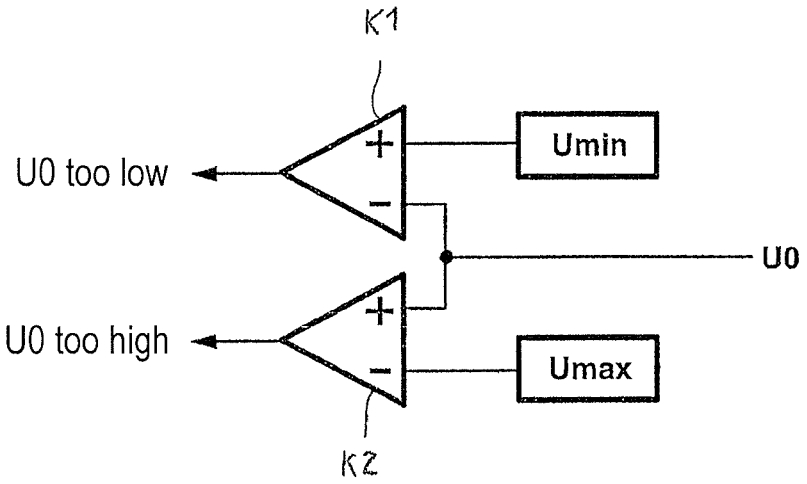
FIG. 11 illustrates a control circuit with comparators.

FIG. 11 shows such a monitoring circuit with comparators K1 and K2 in a schematic presentation. The comparator K1 monitors the underrun of a set minimum value Umin. If the charge voltage U0 is lower than Umin, for example, the level at the output of the comparator K1 will increase, which defines the state "U0 too low". The overrun of the set maximum value Umax for the charge voltage U0 is monitored by the comparator K2. If the charge voltage U0 is higher than Umax, for example, the level at the output of the comparator K2 will increase, which defines the state "U0 too high". The indication of the states "U0 too low" and "U0 too high" is very helpful during the calibration process. Under the circumstances, in calibration it can be necessary to adapt the amplification of the amplifier 170. If the state "U0 too low" is thereby indicated, this means that the set amplification for the liquid developer that is used is too high because the controller 178 cannot regulate the charge voltage down further. In this case, the amplification factor for the amplifier 178 must be reduced. In contrast to this, of the state "U0 is too high" is indicated, this means that the set amplification for the liquid developer that is used with its present attenuation is too low because the controller 178 cannot regulate the charge voltage U0 up. In this case the amplification factor must be set higher.

The monitoring circuit according to FIG. 11 can also be used to detect error states. In spite of a correctly set measurement cell 130 and a correctly set control loop according to FIG. 5, in operation it can occur that the state "U0 too high" is indicated. This can be used as a warning that a delay measurement (a description of this takes place further below) that is possibly implemented does not have sufficient precision because the signal at the receiver is smaller than expected. On the other hand, the state "U0 is too high" can indicate that gas bubbles are located in the measurement cell 130, which negatively affects a precise measurement. Under the circumstances, the monitoring circuit can also detect other error sources as well. The limits for the charge voltage U0 can be exceeded when the piezoceramic elements 144, 146 or the measurement cell 130 have error states. For example, the adhesion of the piezoceramic element 144, 146 could change due to material aging; a break of the piezoceramic element 144, 146 could be present; or the detachment of the contact from the piezoceramic element 144, 146 could be present. Furthermore, a depositing of sediments in the measurement cell 130 could represent an error source and can be detected by the monitoring circuit.

The described method—in which the toner concentration is determined from the attenuation of ultrasonic pulses—can advantageously be combined with a method in which the toner concentration is determined from the travel time of ultrasonic pulses as this is described in the document DE 10 2008 047 196 A1 (Patent Application by the same applicant). The method described there is incorporated as disclosure content into the present Patent Application.

Figure 12:
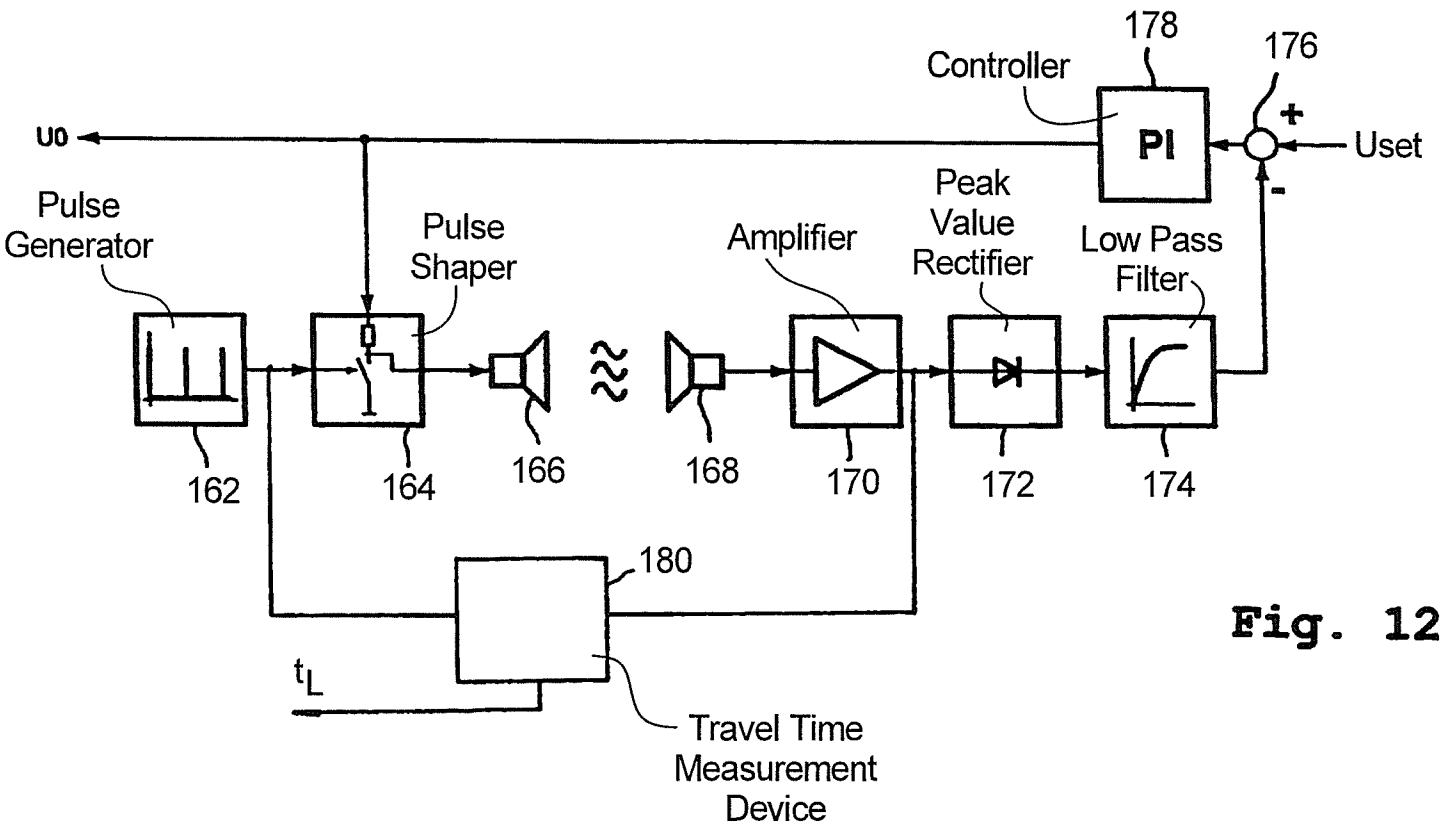
FIG. 12 shows a block representation of a measurement device to determine the attenuation and the travel time of ultrasonic pulses in the measurement cell.

FIG. 12 shows a block representation that coincides with the representation in FIG. 5 with regard to the regulation of the charge voltage U0. A travel time measurement device 180 as it is described in the cited document was additionally added as well. The travel time tL is calculated from the point in time t=0 up to the first zero crossing of a receiver signal after passing a first maximum or minimum. More detailed information can be learned from the cited document.

Figure 13:
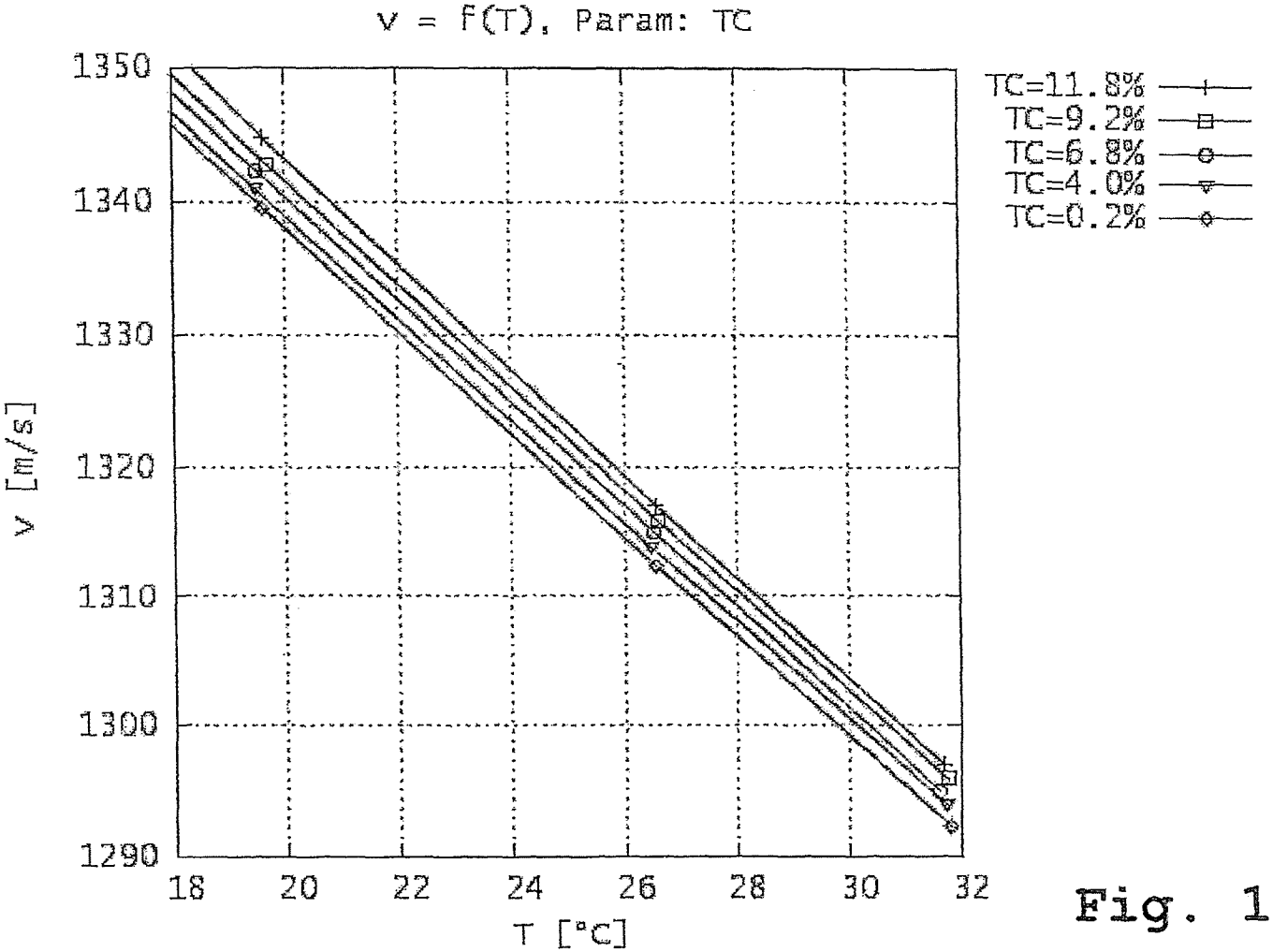
FIG. 13 illustrates the dependency of the sound velocity on the temperature and the toner concentration.

In a diagram, FIG. 13 shows the dependency of the sound velocity v on the temperature T with the toner concentration TC as a parameter. It is apparent that the shown characteristic lines are very strongly dependent on the temperature T, and that—on the other hand—the TC characteristic lines in the measurement region of interest are situated close to one another, such that a slight definition is present. This makes the determination of the toner concentration TC from the obtained measurement values of sound velocity (determined from the travel time tL) and temperature T relatively imprecise, especially as the temperature T can most often be measured only with a severe time delay. It is to be learned from the diagram that, given a constant sound velocity v, a change of the temperature by (for example) 1° C. already changes the toner concentration by 10% in absolute terms. This means that a very precise temperature measurement is required, which poses further difficulties.

Figure 14:
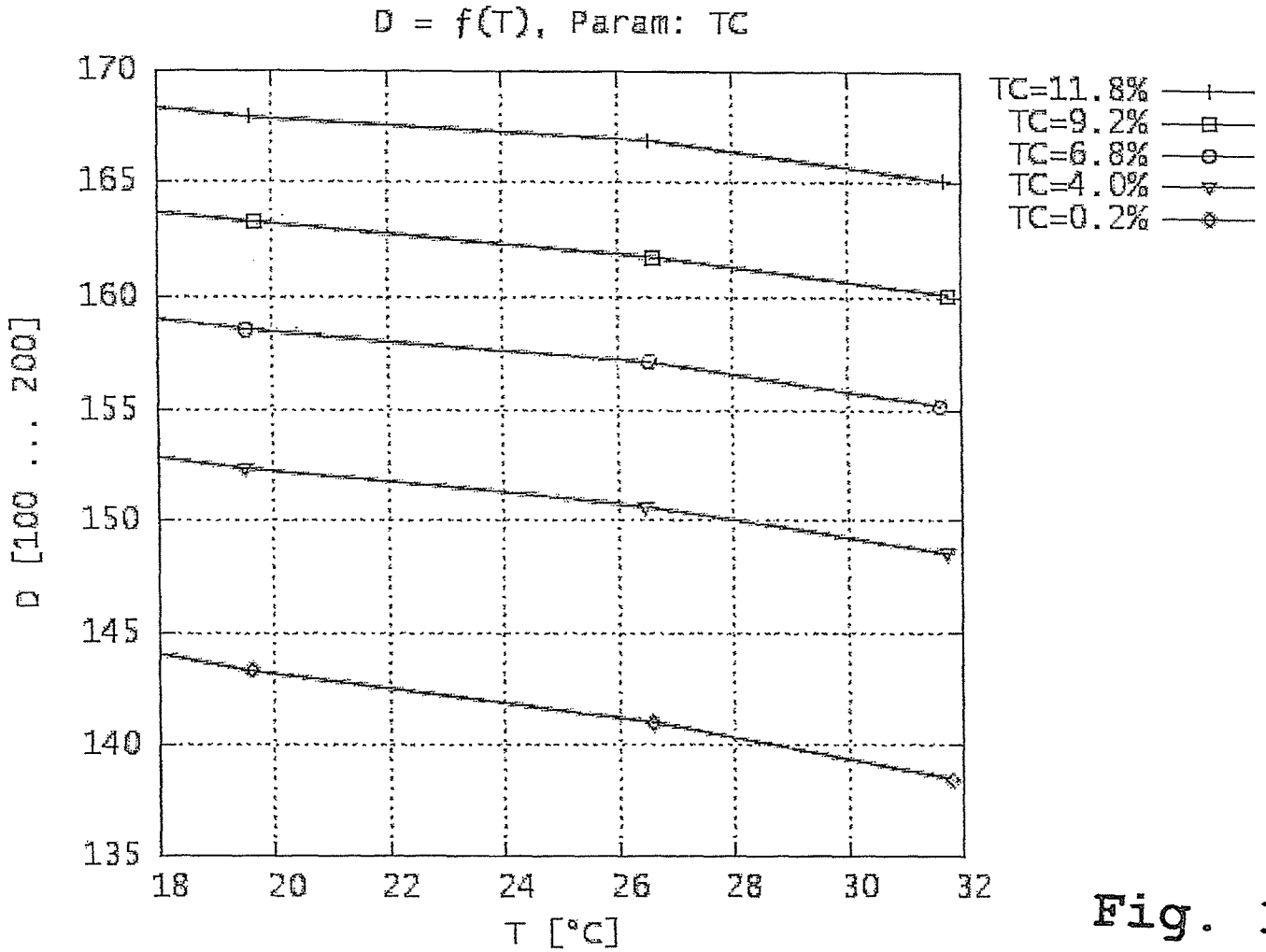
FIG. 14 illustrates the dependency of the attenuation on the temperature and the toner concentration.

In a diagram, FIG. 14 shows characteristic lines with the parameter toner concentration TC. The attenuation D is plotted as a relative value over time T given different TC values. It is to be learned from the diagram that a change of the temperature by (for example) 1° C. changes the TC value by only 0.15% in absolute terms, which means that the determination of the toner concentration from the attenuation is less temperature-sensitive.

Approximation formulas for the toner concentration can be learned from the diagrams according to FIGS. 13 and 14. A simple approximation formula in order to calculate the toner concentration from the sound velocity or, respectively, from the travel time tL is:

$$TC1(v,T)=1.52*v+5.94*T+TC_V0,$$

wherein

TC1 is the toner concentration, determined on the basis of the sound velocity, V is the sound velocity in the medium in m/s, T is the temperature in ° C. and TC_V0 is a correction value.

An approximation formula can be learned from the diagram according to FIG. 14:

$$TC2(D,T)=0.476*D+0.15*T+TC_D0,$$

wherein

TC2 is the toner concentration, determined on the basis of the attenuation,

D is the attenuation and

TC_D0 is a correction summand.

It is advantageous to combine both cited measurement methods to determine the toner concentration. For this, the toner concentration results from the sum of a first summand and a second summand, wherein the first summand is the toner concentration multiplied with a weighting factor (as results from FIG. 14) and the second summand results from the multiplication of a weighting factor with the toner concentration that results from the travel time measurement according to FIG. 13, wherein the auxiliary condition applies that both weighting factors result in a sum of 1. An approximation formula for this reads:

$$TC(v,D,T)=0.87*TC2(D,T)+0.13*TC1(v,T)$$

The aforementioned approximation formula can be generalized as $$TC(v,D,T)=w1*TC1(v,T)+w2*TC2(D,T),$$

wherein w1 and w2 are weighting factors for which it applies that $$w1+w2=1.$$

The weighting factors w1 and w2 can be selected so that the temperature influences for both measurement methods (sound velocity measurement over travel time $t_L$ or attenuation measurement according to diagram in FIG. 14) are minimal or mutually cancel. The measurement of the sound velocity can also take place according to another method, deviation from what is described in DE 10 2008 047 196 A1.

It is advantageous to determine the toner concentration TC from the attenuation D and the temperature T $$TC=f(D,T)$$

and to develop a suitable polynomial for this according to the rule $$TC=K0+K1*D+K2*D^2+K3*T+K4*T^2+K5*D*T+\ldots$$

The polynomial coefficients K1 through K5 and more must be determined separately for each liquid.

The attenuation D results as $$D=\ln(Io/Id)/d,$$

wherein Io is the intensity of the emitted ultrasonic pulse, and Id is the intensity of the received ultrasonic pulse at the distance d.

The intensity of the ultrasonic pulse (or its power) cannot be measured without additional measures. However, since the intensity (or the power) is proportional to the square of the voltage amplitude, an approximate value for the attenuation can be determined as follows:

$$D=\ln(U0^2/U1^2)*K1/d+K0,$$

wherein U0 is the charge voltage that is proportional to that of the amplitude of the emitted ultrasonic pulse,
U1 is the peak value of the receiver voltage,
K1 is a normalization factor,
d is the clearance of the piezoceramic elements and
K0 is an offset to compensate the attenuation measurement.
U1 corresponds the value Us to which the regulation regulates according to the predetermined desired value. For example, this value Us is approximately 3 volts. In one example the clearance d amounts to 0.018 m. A value of 1.1 is found as a normalization factor K1. With the aid of the cited approximations, a close connection with the toner concentration TC can be established over a large measurement range. For example, in practical tests a toner concentration in a range from 0.2% to 11.8% was measured with relatively high precision at a black toner material.

Since both methods to determine the toner concentration are temperature-dependent but have significantly different temperature responses, an optimum with regard to measurement range, measurement precision and temperature response can be achieved via the combination in connection with the weighting factors.

The technical advantages that can be achieved with the aid of the exemplary embodiment as described hereafter:

The signal processing at the receiver is improved with the aid of the regulation as it is described in connection with FIG. 5, for example, because the regulation ensures that the reception signal always has approximately the same pulse level. Accordingly, at the receiver side the critical amplification factor for the evaluation electronics must only be roughly adjusted, and the association electronics are not sensitive to interference. Interfering distortions of the signal on the receiver side (for example given overmodulation) are also prevented by the regulation. After setting an advantageous work point, the amplification factor at the receiver does not need to be changed further, whereby the stability of the circuit is improved because a change to the amplification without a phase shift taking place can only be adjusted with severe difficulty.

Due to the regulation of the charge voltage, without additional cost and with relatively simple means the charge voltage U0 can be used as a measure of the attenuation or, respectively, a measure of the toner concentration after a calibration process.

As has been shown, the method to determine the toner concentration via regulation and via evaluation of the attenuation is dependent on the temperature only to a small degree, which improves the interference resistance overall.

Errors in the total toner concentration measurement system can be detected via the monitoring of the limits of the charge voltage, and warning signals can be output.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to operate a digital printer to print a recording material with toner particles that are applied with aid of a liquid developer, comprising the steps of:

determining toner concentration of the liquid developer via measurement in a measurement cell with aid of at least one ultrasonic pulse;

generating said at least one ultrasonic pulse by discharging an ultrasound emitter charged with a charge voltage, said ultrasonic pulse permeating the liquid developer and being received by an ultrasound receiver which generates a reception signal corresponding to the received ultrasonic pulse;

with a control device, regulating the charge voltage based on the reception signal to a value such that a representative value of the reception signal corresponds to a predetermined desired value; and determining the toner concentration from the regulated charge voltage.

2. The method according to claim 1 wherein a peak value that is filtered by a lowpass filter is used as said representative value of the reception signal.

3. The method according to claim 1 wherein temperature of the liquid developer is measured and taken into account in the determination of the toner concentration.

4. The method according to claim 1 wherein a travel time of the ultrasonic pulse is determined, and said travel time is taken into account in the determination of the toner concentration.

5. The method according to claim 4 wherein a temperature of the liquid developer is taken into account in the determination of the travel time.

6. A digital printer, comprising:

a print unit to print a recording material with toner particles that are applied with aid of a liquid developer;

a measurement cell which determines toner concentration of the liquid developer via measurement with aid of at least one ultrasonic pulse;

an ultrasound emitter which is charged with a charge voltage and which is discharged to generate at least one ultrasonic pulse, said ultrasonic pulse permeating the liquid developer and being received by an ultrasound receiver which generates a reception signal corresponding to the received ultrasonic pulse; and a control device that regulates the charge voltage based on the reception signal to a value such that a representative value of the reception signal corresponds to a predetermined desired value, the toner concentration being determined from the regulated charge voltage.

7. The digital printer according to claim 6 wherein a peak value is determined as a representative value for the reception signal, said peak value being filtered by a lowpass filter.

8. The digital printer according to claim 6 wherein the measurement cell comprises a hollow sensor body on opposite external sides of which are arranged a respective piezoceramic element in an associated recess.

9. A method to operate a digital printer to print a recording material with toner particles that are applied with aid of a liquid developer, comprising the steps of:

determining toner concentration of the liquid developer via measurement in a measurement cell with aid of at least one ultrasonic pulse;

generating said at least one ultrasonic pulse by activating an ultrasound emitter controlled with a control voltage, said ultrasonic pulse permeating the liquid developer and being received by an ultrasound receiver which generates a reception signal corresponding to the received ultrasonic pulse;

with a control device, regulating the control voltage based on the reception signal to a value such that a representative value of the reception signal corresponds to a predetermined desired value; and determining the toner concentration from the regulated control voltage.

10. A digital printer, comprising:

a print unit to print a recording material with toner particles that are applied with aid of a liquid developer;

a measurement cell which determines toner concentration of the liquid developer via measurement with aid of at least one ultrasonic pulse;

an ultrasound emitter which is activated with a control voltage and which is discharged to generate at least one ultrasonic pulse, said ultrasonic pulse permeating the liquid developer and being received by an ultrasound receiver which generates a reception signal corresponding to the received ultrasonic pulse; and a control device that regulates the control voltage based on the reception signal to a value such that a representative value of the reception signal corresponds to a predetermined desired value, the toner concentration being determined from the regulated control voltage.

11. A method to operate a digital printer to print a recording material with toner particles that are applied with aid of a liquid developer, comprising the steps of:

providing a measurement cell to determine toner concentration of liquid developer via measurement in the measurement cell with aid of at least one ultrasonic pulse;

measuring a temperature of the liquid developer and generating said at least one ultrasonic pulse by discharging an ultrasound emitter charged with a charge voltage, said ultrasonic pulse permeating the liquid developer and being received by an ultrasound receiver which generates a reception signal corresponding to the received ultrasonic pulse;

with a control device, regulating the charge voltage based on the reception signal to a value such that a representative value of the reception signal corresponds to a predetermined desired value; and determining a value for attenuation of the developer fluid from said charge voltage and the reception signal, and determining the toner concentration from said attenuation and said temperature via approximation via a polynomial.

12. A method to operate a digital printer to print a recording material with toner particles that are applied with aid of a liquid developer, comprising the steps of:

providing a measurement cell to determine toner concentration of the liquid developer via measurement in the measurement cell with aid of at least one ultrasonic pulse;

generating said at least one ultrasonic pulse by discharging an ultrasound emitter charged with a charge voltage, said ultrasonic pulse permeating the liquid developer and being received by an ultrasound receiver which generates a reception signal corresponding to the received ultrasonic pulse;

determining a travel time of the ultrasonic pulse;

with a control device, regulating the charge voltage based on the reception signal to a value such that a representative value of the reception signal corresponds to a predetermined desired value;

also determining a travel time of the ultrasonic pulse; and determining the toner concentration from the regulated charge voltage, said travel time being taken into account in the determination of the toner concentration, and wherein the toner concentration is calculated from a sum of a first summand and a second summand, where the first summand is the toner concentration multiplied with a weighting factor, said first summand resulting under consideration of the regulated charge voltage, and the second summand being derived from a multiplication of a weighting factor with the toner concentration that results from measurement of said travel time.

* * * * *